US006478574B1

(12) United States Patent
Melcher et al.

(10) Patent No.: US 6,478,574 B1
(45) Date of Patent: Nov. 12, 2002

(54) PUMP PURGE FOR OIL PRIMARY

(75) Inventors: Amy L. Melcher, Minneapolis, MN (US); Richard W. Simons, Golden Valley, MN (US); Henry E. Troost, IV, River Falls, WI (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/621,257

(22) Filed: Jul. 21, 2000

(51) Int. Cl.[7] ..... F23Q 23/00

(52) U.S. Cl. ..... 431/30; 431/18; 431/29; 431/62; 431/72; 431/73; 431/6

(58) Field of Search ..... 431/6, 29, 30, 431/31, 67, 70, 71, 69, 27, 73, 72, 18; 126/116 A

(56) References Cited

U.S. PATENT DOCUMENTS 3,051,227 A * 8/1962 Robson
3,320,998 A * 5/1967 Momchilovich
3,963,018 A * 6/1976 Schultz
4,351,316 A * 9/1982 Kroll
4,999,792 A 3/1991 Anderson et al.
5,085,573 A 2/1992 Geary
5,470,223 A * 11/1995 McCoy
5,894,988 A * 4/1999 Brenner et al.

FOREIGN PATENT DOCUMENTS

EP 0143865 A 6/1985
GB 2074713 A 11/1981

OTHER PUBLICATIONS

Honeywell Brochure: R4184D; R8184G, M, N,P Protectorelay® Oil Primary Controls, No Date.

* cited by examiner

*Primary Examiner*—Carl D. Price
(74) *Attorney, Agent, or Firm*—Kris T. Fredrick

(57) ABSTRACT

An oil burner control system is disclosed in which an extended time may be temporarily selected, in situations such as initial set up or periodic maintenance, for priming the pipes, filters and pumps, before a safety lockout of system operation occurs, while otherwise leaving the normal safety lockout functions intact. An igniter in the system operates in an "intermittent" mode during the temporarily selected extended time, and otherwise operates in an "interrupted" mode.

15 Claims, 2 Drawing Sheets

PUMP PURGE FOR OIL PRIMARY

BACKGROUND OF THE INVENTION

1. Field of the Invention

The present invention relates to burner systems and more particularly to an oil burner system and control that will, when needed, provide for pumping of oil through the system in a manner to avoid going into safety lockout without overriding the safety function.

2. Description of the Prior Art

Oil burner systems for use in furnaces, boilers, water heaters etc. are well known lo in the prior art. A typical prior art system for use with an oil-fired furnace is shown in FIG. 1. In FIG. 1, an oil burner 10 is shown having a blower 12, in the lower portion thereof, and a spark igniter 14, in the upper portion thereof. A pump 16 is shown attached to the blower 12 and a supply conduit 18 connects pump 16 to a source of oil (not shown). A motor 20, which operates blower 12 to produce a stream of air, is also shown attached to pump 16. Pump 16 is operable by motor 20 to pump a fine mist of oil combined with the stream of air through blower 12 and into a combustion chamber 24 of a furnace (not shown). The spark igniter 14 employs a pair of spark electrodes 26 which, when energized, produce a spark across the gap therebetween to ignite the mist of oil and swirl the burning fuel into the combustion chamber 24 where the heat generated will be circulated to the house or other area to be heated. A flame detector such as a cad cell 28 views the combustion area to determine whether or not combustion has occurred.

A primary controller 30, which may be an R8184 manufactured by Honeywell International Inc., is shown receiving signals from a thermostat 32 over lines 34 and acts to control the operation of the oil burner 10. More particularly, when thermostat 32 sends a signal calling for more heat, primary control 30 sends a signal from terminals 40 over lines 41 to the spark igniter 14 that then operates to produce a spark across the gap between electrodes 26. Primary control 30 also sends a signal from terminals 44 over lines 45 to energize motor 20, blower 12 and pump 16 to start the mist of oil and air flowing from the blower section 12 to combustion chamber 24. If the oil and air are present and the spark ignites the oil, then the flame detector 28 provides a signal over lines 46 to terminals 47 of controller 30 to indicate that satisfactory operation has occurred. Thereafter, spark igniter 14 continues to produce a spark across the gap between electrodes 26 (referred to as "intermittent" operation) and the furnace produces heat until the call for heat is lost and the motor 20, the pump 16 and the igniter 14 are shut off.

The R8184 system works very nicely for substantially all normal situations that are encountered. Unfortunately, on occasions such as when the furnace is initially set up or when it undergoes extensive service, the oil lines and filter may be depleted and considerable time may elapse before air can be purged from the lines, the oil filter saturated and the oil pumped to the combustion chamber 24. Under such circumstances, when motor 20 is activated to drive blower 12 and pump 16, the spark igniter 14 produces a spark that does not ignite the oil. When the flame detector 28 does not produce a signal within a predetermined time period, (usually about 45 seconds), a safety lockout is activated which prevents further operation until the primary controller 30 is reset. A reset button 50 is provided for this purpose and after it is pushed, another delay, (sometimes as much as an additional 20 minutes) occurs before the lockout can be removed. This can be time consuming and irritating to the service technician, so many service technicians have learned that the lockout delay can be overridden by putting a jumper or short circuit across the cad cell 28. More particularly, a wire operable to produce a short circuit can be placed across terminals 47. Although this is not recommended procedure, it allows the technician to avoid the lockout which would otherwise occur after 45 seconds and the additional 20 minute delay before the lockout can be removed. Obviously, this permits more rapid maintenance but the result may be that the pump keeps pumping oil to the burners without ignition and an excess of oil may flow into the oil burner. This can be dangerous and at least requires significant and costly clean up. Furthermore, the technician may forget to remove the jumper and the control 30 will continue to believe there is flame when there is not, causing additional service requirements.

BRIEF DESCRIPTION OF THE INVENTION

In the present invention, several features have been provided to improve the operation of the prior art. The primary distinguishing feature is the provision of a "pump priming" or "pump purging" mode to be described below. Also, the terminals 47 to which the cad cell 28 are connected have been moved away from the rest of the terminals and placed between the primary control 30 box and the oil burner 10 surface to which primary control 30 is mounted. In this position, a jumper cannot be placed across these terminals without removing the entire primary control unit 30. Furthermore, a restricted lockout feature is provided that only allows a predetermined number of times that the system can go into lockout before the system is disabled. This feature is disclosed and claimed in our co-pending application of entitled "Restricted Operating Modes for Oil Primary" Ser. No. 09/734,534, filed Dec. 11, 2000 and assigned to the assignee of the present invention. This restricted lockout feature requires something other than pushing the reset button 50 to restart the system (for example, a significant waiting period). The present invention provides a secondary override for use when the system is in restricted lockout. This may take the form of a pushing and holding of the reset button 50 for a predetermined time period (for example, 30 seconds) after which normal start up operation can resume. In any event, the side effect of slowing the service technician down occurs and, as described above, is costly from a time consumed measure and irritating to some technicians. To avoid this, the present invention provides a "pump priming" or "pump purge" feature to allow fuel oil to be pumped through the system without waiting the delay period that occurs by going into safety lockout. More particularly, a service technician, when he wishes to rapidly purge the system, can place the primary control in a "pump priming" mode by using a predetermined technique. For example, the reset button 50 may be pushed and released during any one of three operation states, i.e., the Valve On Delay state, the Trial For Ignition state or the Carry Over state (all of which will be described below). The "pump priming" mode allows the safety switch timing to be extended, for example, from 30 seconds to 4 minutes and permits enough time for the oil to be pumped through the system. In the present invention, the igniter is normally turned off after a short delay subsequent to combustion having occurred (referred to as "interrupted" operation) and allows power savings, less electrode wear, less noise and longer component life. However, during "pump priming" operation, an air bubble could temporarily prevent oil flow, which could result in flame out. The present invention therefore provides for changing the ignition type from "interrupted" to "intermittent" (as explained above where ignition remains on for the entire heating cycle) during "pump priming" operation. This increases the chance that the flame will be maintained even though an air bubble or other temporary obstruction occurs in the fuel line. These changes are effective for the current combustion cycle only, i.e., until the call for heat disappears. Thereafter, the primary control reverts to the normal safety switch timing and "interrupted" ignition operation on the next call for heat. If desired, a restriction may be added to prevent an unskilled person from employing the "pump purge" feature. For example, the pump purge may be inhibited if the primary control has been locked out since its most recent complete heat cycle. One way of doing this is to use a counter to count the number of times that the primary control has gone into lockout and, whenever the count is not zero, it would prevent the control from going into "pump priming" mode. The counter could be zeroed by techniques known only to service technicians such as pushing and holding the reset button for an extended period (e.g., 30 seconds) or pushing the reset button a predetermined number of times.

Other changes include 1) connecting a valve in the oil line 18 to allow independent control of oil flow by the primary controller, 2) preventing the valve from being turned on until the igniter 14 and the motor 20 have been activated; 3) the provision of a remote alarm which allows the system to be connected to the security system to provide an alert when the system is locked out; and 4) the provision of an indicator, such as an LED light, which is programmed to provide various information at various stages of operation by, not only its on or off condition, but by flashing at various rates.

DETAILED DESCRIPTION OF THE PREFERRED EMBODIMENTS

Figure 1:
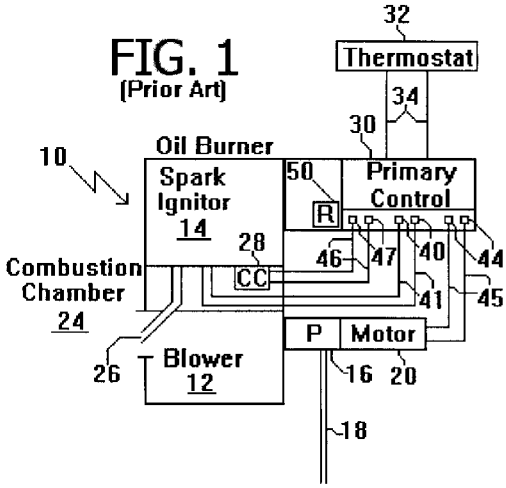
FIG. 1 (Prior Art)
FIG. 1 is a block diagram of a burner control in the prior art.
Figure 2:
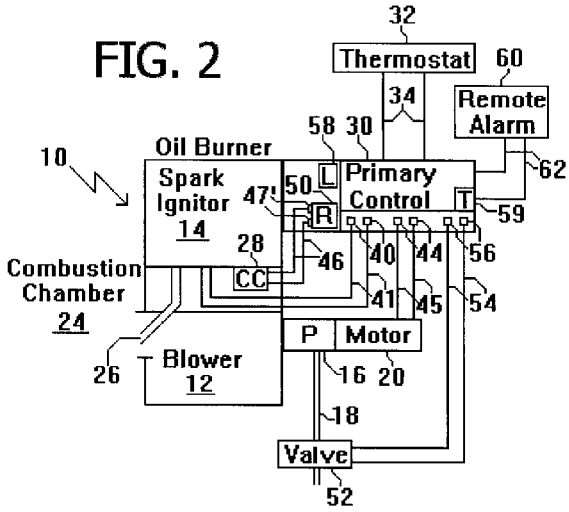
FIG. 2 is a block diagram of a burner control of the present invention.

In FIG. 2, elements of FIG. 1 having the same function are shown with the same reference numerals. FIG. 2 is quite similar to FIG. 1 but includes a valve 52 connected in the oil supply conduit 18 and operable by the primary control 30 via lines 54 which are connected to terminals 56. This allows the oil flow to be controlled independently of the operation of motor 20. With valve 52, oil can be prevented from flowing into combustion chamber 24 until motor 20 and igniter 14 are activated. It should be understood that controller 30 contains, among other things, a RAM for storing variables and constants (e.g., counters, resistor values, cad cell calibrations, etc), a ROM for storing the software for the system, etc., an EEPROM for storing specific configurations for the model such as the lockout timer, the model number, etc., and DIP switches to store values such as blower-off delay times to be utilized during the operation of the system as will be described. Also shown in FIG. 2 is an indicator light 58, which may be a LED, shown on the primary control 30, which operates to provide a visual indication when combustion in chamber 24 has occurred and has other information providing features as will be described. Also, in FIG. 2, the terminals 47, of FIG. 1, that were capable-of being jumpered to avoid lockout, have now been placed in the interface area between the primary control 30 and the oil burner 10 as is seen by reference numeral 47'. So located, these terminals cannot be jumpered without removing the entire primary control 30 from the oil burner 10. Also shown in FIG. 2 are timers 59 which are used to provide timing signals to the primary controller 30 at various stages of operation, as will be described. Finally, a remote alarm 60 is shown connected to the primary control 30 by lines 62 for purposes of producing a signal (for example to the home security system) that can alert the user that a lockout has occurred and that service should be performed.

Figure 3:
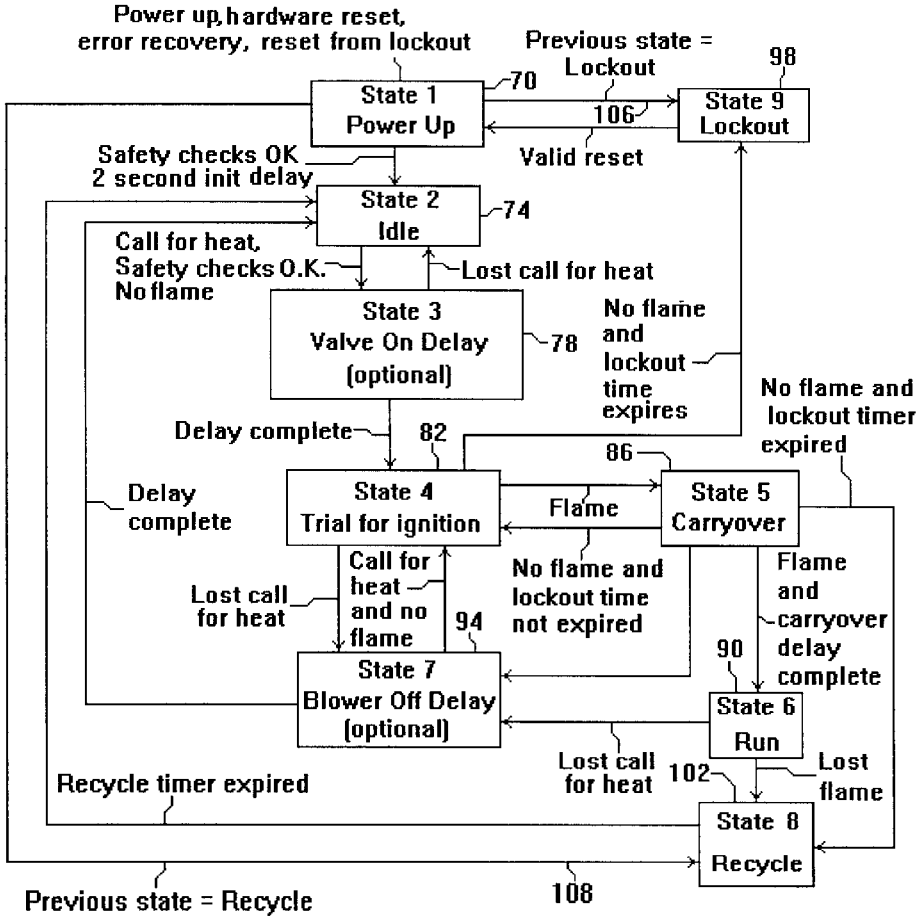
FIG. 3 is a state diagram showing the various states of operation of the present invention.

The operation of FIG. 2 can be understood by reference to FIG. 3 that shows the various states that the system may occupy during its operation. The normal operating sequence will be described first as follows:

Upon "Power Up", State 1, shown by box 70, the primary control 30 performs checks to verify that conditions which would preclude proper system operation are not present. The system would then go to Idle, State 2, shown by box 74, where the controller 30 would make a check to assure that the flame was out and cause the system to wait for a call for heat from thermostat 32. Upon receiving a call for heat, the system would move to Valve On Delay, State 3, shown by box 78, where the controller 30 would perform certain safety checks, would again check to assure that there was currently no flame and would enable igniter 14 and energize motor 20 and start a timer to delay the opening of valve 52 until after motor 20 and igniter 14 were on. Upon completion of the timer, the system would move to Trial For Ignition, State 4, shown by box 82, where the controller would open valve 52 and a stream of oil and air would pass the igniter electrodes 26 and combust. When the flame is detected by cad cell 28 and a signal would be sent to controller 30, the system would move to Carryover, State 5, shown by box 86, where another short delay occurs (for example 10 seconds) to assure that the flame is self sustaining at which time the igniter 14 would be extinguished and the system would move to Run, State 6, shown by box 90, where the heating continues until the call for heat is lost. When this occurs, the system would either move 1) directly to Idle, State 2 where the igniter 14, blower motor 20 and valve 52 are turned off or 2) to an optional Blower Off Delay, State 7, as shown in FIG. 3 by box 94, where the igniter 14 and valve 52 are turned off but a timer is activated to allow the blower motor 20 to remain on a short time while the hot air is pushed through and out of the system. In either event, the system returns to State 2 where it again waits for a call for heat. If the optional Blower Off Delay State 7, box 94 is not used, the "Lost Call For Heat" arrow from Trial for Ignition, State 4, box 82 would also lead directly to Idle, State 2 and the "Call For Heat And No Flame" arrow would be eliminated.

In the event that the burner 10 is just being installed or has undergone extensive maintenance, the oil in the lines and filter may be dry in which case, the above procedure could result in a "no flame" condition at State 4 and, after a delay, the system would go to lockout, State 9, shown by box 98 and the reset button 50 would have to be pushed to start the procedure over again. This could occur twice, after which the system would go to restricted lockout and could not again be started by merely pushing the reset button 50 again. To avoid this, the present invention provides that the reset button 50 can be pushed during States 3–5 and the timing in State 4 would then be increased to a value sufficient for the oil to fill the conduits and the filter and flame can be established. After this longer delay in State 4, a detection of flame would move the system to State 5, as before, and operation would continue as above described. The pressing and releasing of the reset button 50 during States 3–5 would put the system into priming mode only when there has been no lockouts which may be determined by monitoring a "lockout counter" to be described.

A more detailed description of the various States and their function is as follows:

State 1, box 70, is entered when power up occurs, when hardware is reset, when there is an internal error recovery, i.e., checking system values such as lock out timing and an error is discovered, or when there is a reset from a lockout state. In State 1, the RAM is zeroed and, a short delay (e.g., 2 seconds) is initiated for system stabilization. Various safety checks are performed such as cad cell calibration, the. EEPROM values are read to verify that various parameters are within accepted standards and delay times are checked from the DIP switches. If the previous state was either Lockout, State 9 or Recycle, State 8, to be described, the system will go to that state. Otherwise the system goes to Idle, State 2, box 74 where it will await a call for heat.

In State 2, the burner motor 20, the oil valve 52 and the alarm 60 are off and the system is now waiting for the next call for heat. The igniter is enabled, i.e., ready to be energized, in case the blower motor 20 is stuck in an unsafe condition. The flame is monitored and the indicator light 58 will be on if there is a flame, otherwise indicator light 58 is off. A check is made of the thermostat to see if it is calling for heat and, if so, the cad cell 28 is calibrated and another short delay (e.g., two seconds) is set. After the delay the thermostat is checked again. If the thermostat is still calling for heat, a safe check is made to verify that the flame is off, and a check sum test is performed on the ROM. When everything is satisfactory, system goes to the Valve On Delay, State 3, box 78.

In Valve On Delay, State 3, box 78, a check is made to see if the "valve on" delay is disabled. If not, another delay is set for pre-selected time. The blower motor 20 and igniter 14 are started at the beginning of the delay. During the delay, the thermostat 32 "on" flag is monitored. If the call for heat is lost, the system returns to Idle, State 2. If not, at the end of the "valve on" delay, the control goes to Trial for Ignition, State 4, box 82.

In Trial For Ignition, State 4, the oil valve 52 is energized and a lockout timer is started. The thermostat "on" flag and flame level (on or off) are monitored. If the call for heat is lost, control goes to the Blower Off Delay, State 7, box 94 or Idle, State 2, box 74 depending on the option. Otherwise, the system stays in State 4 until either the flame is proven (i.e., "on") or the lockout timer expires before flame is proven. If the lockout timer expires, the system goes to Lockout, State 9, box 98. If the flame is proven, the system goes to Carry Over, State 5., box 86.

In State 5, the LED 58 is turned on and the carryover timer is started. The carryover timer provides a time interval for allowing the flame to stabilize. Both the lockout timer and the carryover timer are active in State 5. The thermostat "on" flag and the flame level are monitored and both timers are monitored. If the call for heat is lost, control goes to Blower off Delay, State 7, box 94 or Idle, State 2, box 74 depending on the option. If the flame is lost, the LED 58 is turned off and the lockout timer is checked. If flame is lost and the lockout timer has not expired, the system returns to the Trial for Ignition, State 4. If the flame is lost and the lockout timer has expired, control goes from State 5 to State 4 and to Lockout, State 9. If the carryover timer expires, control goes to Run, State 6, box 90.

In State 6, the oil valve 52 and blower motor 20 are on but igniter 14 is turned off and the burner continues on by itself. As mentioned, when lockout occurs, the reset button 50 may be pressed to remove the lockout, but only twice. On the third time, the system goes into a restricted lockout status where the reset button must be depressed for 30 seconds before reset can occur. In state 6, since the flame is now self-sustaining, the lockout counter is cleared and this fact is stored in the RAM and EEPROM. The system will normally stay in State 6 until the thermostat indicates enough heat has been generated. The thermostat "on" flag, the flame level and the reset button are monitored. If flame is lost, control goes to Recycle, State 8, shown by box 102. If the reset button 50 is pushed, the program causes the LED 58 to flash at a repetition rate that shows the general resistance range of the cad cell 28. If the call for heat is lost, the LED is turned off to show this condition, the error counter is cleared and the system goes to Blower Off Delay, State 7, box 94, or as mentioned above, depending on the option, to Idle, State 2.

In State 7, the igniter 14 and oil valve 52 are turned off. It is desired that the blower motor 20 remains on for a predetermined time to move the air out of the system so, a check is made to see if the blower off delay is disabled. If not, the delay. value is obtained and the blower off is delayed accordingly. The flame and the thermostat "on" flag are monitored. If the thermostat is on, another short (e.g., two second) delay is set and the flame off is checked after which the thermostat is checked again. If the thermostat is still on, the program returns to the Trial for Ignition, State 4, box 82. If the flame is on, the system will remain in the Blower Off Delay, State 7, box 94 until delay is complete after which blower motor 20 is turned off and control goes to Idle, State 2, box 74.

In Recycle, State 8, box 102, the system has had a proven flame that has subsequently gone out. The fact of being in Recycle, State 8, box 102 is recorded in the EEPROM and the blower motor 20 and oil valve 52 are turned off. While in State 8, the igniter 14 is enabled in case the blower is stuck "on", the recycle timer is started and the LED 58 is flashed slowly to show the user that the system is in State 8. When the recycle timer expires, the LED is turned off, the Idle, State 2 is entered and this fact is recorded in EEPROM. The Recycle feature is more completely explained and claimed in our co-pending application entitled "Limited Recycle for Primary Controls" filed Jul. 21, 2000 with Ser. No. 09/621,259 and assigned to the assignee of the present invention.

In Lockout, State 9, box 98, the state value is written to EEPROM. A lockout counter, which keeps track of the number of lockouts, is incremented and the value written to EEPROM. The burner motor 20 and oil valve 52 are turned off and the alarm is turned on. The igniter 14 is enabled in case the blower motor is stuck "on". The LED is fast flashed to show the system is in lockout, and the reset button 50 is monitored. If the reset button 50 is pushed and the number of lockouts since the last successful run is less than three, as determined by the lockout counter, the LED and the alarm relay are turned off. The Idle, State 2, state variable is saved in EEPROM and the system goes to Power Up, State 1, box 70. If there has been three or more lockouts, and if the reset button 50 is then pushed, it must be held down for 30 seconds or more after which the LED is turned off, the alarm is turned off, the Idle state variable is saved in EEPROM and the system goes to Power Up, State 1, box 70. Otherwise, the system continues to be in Lockout, State 9.

The Lockout, State 9, box 98 and the Recycle, State 8, box 102 have a precaution built in. In some computers, when the power is turned off, the state of the various conditions is lost and the system starts again from zero. In the present invention, the fact that one of the "Lockout" or "Recycle" conditions existed is stored in the non-volatile memory so that when the system is again powered, the system will return to the Lockout State 9 or Recycle State 8, as is shown by arrows 106 and 108 respectively, and will not go to State 2.

Figure 4:
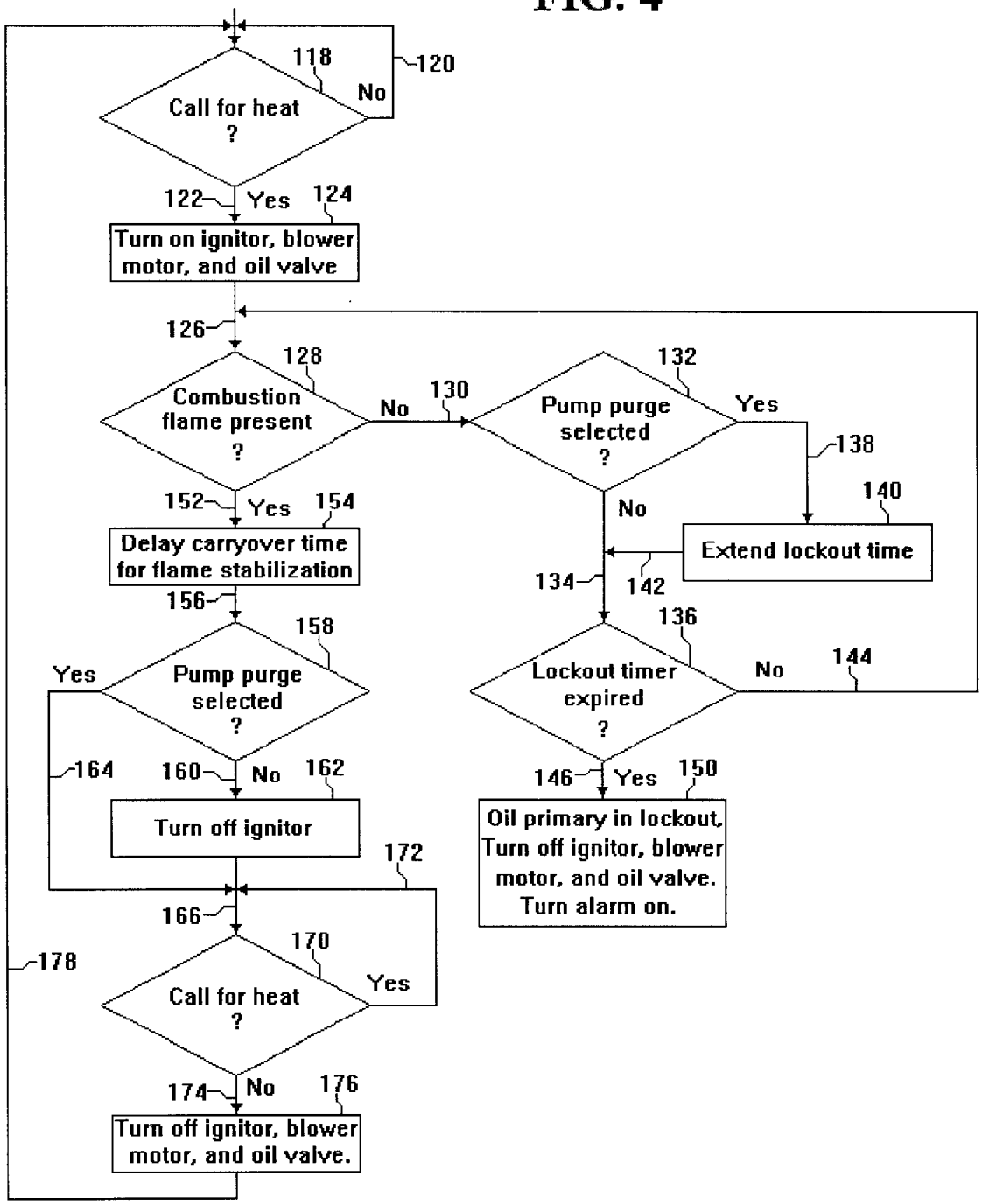
FIG. 4 is a flow diagram representing the operation of the software of the present invention.

FIG. 4 shows a simplified logic flow diagram for the burner control program of the present invention. It will be assumed that primary controller 30 is energized and the system is stabilized as in State 1, discussed above. The various safety checks have been performed, the EEPROM values are read and the delay times have been checked from the DIP switches. The previous state value is determined not to be either Lockout, State 9 or Recycle, state 8 so the system is in State 2, awaiting a call for heat. This is shown in FIG. 4 as diamond box 118. Arrow 120 shows the continual checking for a call for heat and recycling when it is not found. When the call for heat is "yes", as shown by arrow 122, then the igniter 14 and the blower motor 20 are turned on and, after a delay, the oil valve 52 is turned on as explained above in connection States 3 and 4. This is shown in FIG. 4 as box 124. Ignition is attempted as shown by arrow 126 and the existence of a flame is checked as shown by diamond box 128. If a flame is not detected, as shown by arrow 130, then a check is made to determine if the "pump purge" mode has been selected. This is shown in FIG. 4 by diamond box 132. If "pump purge" has not been selected, as shown by arrow 134, then a check is made to see if the lockout timer has expired as shown by diamond box 136. If the "pump purge" has been selected, as shown by arrow 138, then the time for lockout is extended, preferably to about four minutes, as is shown by box 140 and arrow 142. Either the non-extended or the extended lockout timer is checked in diamond box 136 and when the lockout timer has not expired, then the system reverts back to the diamond box 128, as shown by arrow 144 to check the combustion flame. If flame is still not detected the system will continue through the loop formed by diamond boxes 132 and 136 until the lockout timer, either under non-extended or under extended time expires, at which time the system goes into Lockout, State 9, as shown by arrow 146, and the igniter 14, blower motor 20 and oil valve 52 are turned off and the alarm 60 is turned on as is shown by box 150.

When the combustion flame is checked in diamond box 128 and a flame is detected, as shown by arrow 152, then there is a delay time, preferably about 10 seconds, where the flame is established as is discussed in connection with State 5 above. This is shown in FIG. 4 by box 154. After the delay expires, as shown by arrow 156, the system is checked to determine if the "pump purge" mode has been selected as shown by box 158. If pump purge has not been selected, as shown by arrow 160, the system will continue burning without the igniter on, as explained in connection with State 6 above and the igniter will be turned off as shown by box 162. If the pump purge has been selected, as shown by arrow 164, then the igniter 14 is not turned off. In either case, whether the igniter is on or off, as shown by arrow 166, the system will continue to run, as in state 6 above so long as there continues to be a call for heat as shown by diamond box 170 and arrow 172. The flame is also monitored and, if lost, the system will revert to the Recycle State 8 as explained above.

As soon as the call for heat is ended, as shown by arrow 174, the igniter 14 and the oil valve 52 will be turned off and, after a predetermined delay, the blower motor 20 will be turned off, as shown by box 176 and the system will revert to the Idle, State 2 awaiting a call for heat as shown by arrow 178.

It is therefore seen that we have provided an oil burner control system with a "pump purge" mode which permits an extended start-up period before lockout occurs. Many other novel features have been included, such as control of the fuel flow with a valve independently activated by the primary control, concealing the terminals from the flame detector so as to prevent the shorting out thereof, and providing a remote alarm and an LED indicator which can impart various information by the repetition rate of flashing as well as being on and off when operating in various states.

It will be understood that while the present invention has been shown in a preferred embodiment to operate the oil-fired burner of a furnace, the invention may be used with boilers, water heaters and other equipment. Also, where a thermostat 32 has been shown to provide the call for heat, an Aquastat® or other heat detecting device may be employed. The light 58 need not be an LED and could be any other type of indicator either visual or auditory. Furthermore, many of the logic sequences disclosed may be considered optional and alternate sequences may be utilized.

It should therefore be considered that the invention is not limited to the specific apparatus and logic sequences shown in connection with the preferred embodiment and applicant does not wish to be limited to such specific apparatus or logic. The scope of the invention is set forth in the claims appended hereto.

What is claimed is:

1. In a burner control system having an igniter, motive means to direct fuel to be ignited, a flame detector to determine the occurrence of combustion and a safety lockout which, when activated, at least temporarily disables the system if fuel ignition does not occur within a predetermined time after occurrence of a predetermined one of energizing the igniter, energizing the motive means, and energizing both the igniter and the motive means, which safety lockout may undesirably delay completion of a system start-up sequence in certain predetermined situations where the system requires priming before the motive means can produce a necessary fuel flow, comprising:

switch means connected to the system and operable upon activation to produce a signal; and timing means connected to receive the signal and operable to extend the time between occurrence of the predetermined one of energizing the igniter, energizing the motive means and energizing both the igniter and the motive means, and the imposing of the lockout condition to a value normally sufficient to allow priming of the system.

2. The furnace control system of claim 1 wherein:

the igniter is normally energized during a period which extends substantially only until the predetermined time after occurrence of the predetermined one of energizing the igniter, energizing the motive means and energizing both the igniter and the motive means; and upon activation of said switch means, the igniter is energized continuously for the duration of the extended time established by said timing means.

3. Apparatus according to claim 2 further including an indicator connected to the flame detector to provide a user indication of the condition of combustion.

4. Apparatus according to claim 3 wherein the indicator is an LED which turns on to show the user that flame has been detected.

5. Apparatus according to claim 3 wherein the connection between the indicator and the flame detector is made inaccessible to the user.

6. Apparatus according to claim 1 further including an alarm connected to the control system to receive a signal whenever the safety lockout is activated.

7. Apparatus according to claim 1 wherein the motive means includes a blower motor and a fuel valve connected to the control system and independently operable when activated, to direct air and fuel respectively past the igniter.

8. Apparatus according to claim 7 wherein the control system operates to prevent the fuel valve from being activated until after the igniter and blower motor have been activated.

9. Apparatus according to claim 1 wherein, a predetermined time after combustion is detected, the igniter is de-activated and the combustion continues in a self-sustaining manner.

10. A combustion control system comprising:

a combustion chamber;

a primary control;

an igniter for producing, when activated, an electrical discharge proximate the combustion chamber, the igniter connected to the primary control to be activated thereby;

a blower motor for producing, when activated, a stream of air past the igniter into the combustion chamber, the blower motor connected to the primary control to be activated thereby;

a fuel valve for receiving and, when activated, for transmitting fuel into the stream of air past the igniter into the combustion chamber, the fuel valve connected to the primary control to be activated thereby;

a flame detector operable to produce a first signal to the primary control when the igniter ignites the fuel in the combustion chamber;

a timer operable to produce a second signal to the primary control a first predetermined time after the igniter is activated and the combustion detector fails to produce a first signal, the primary control operable in accordance with the second signal to lock the system to prevent further activation of the igniter until a third signal is received;

a switch, operable by a user after the system is locked, to produce the third signal to the primary control permitting a second ignition attempt, the switch also operable by a user, prior to the primary control receiving the second signal, to produce a fourth signal to the primary control, the primary control operable upon receiving the fourth signal to extend the first predetermined time to a second predetermined time sufficient to allow ignition.

11. Apparatus according to claim 10 further including a LED having terminals connected to the flame detector and operable to turn on when a flame is detected to show the user that combustion has occurred.

12. Apparatus according to claim 11 wherein the terminals are made inaccessible to the user.

13. Apparatus according to claim 10 further including an alarm connected to the primary control to receive a signal whenever the second signal is received by the primary control.

14. Apparatus according to claim 10 wherein the primary control operates to prevent the fuel valve from being activated until after the igniter and blower motor have been activated.

15. Apparatus according to claim 10 wherein, a predetermined time after combustion is detected, the igniter is de-activated and the combustion continues in a self-sustaining manner.

* * * * *